US006460536B2

(12) United States Patent
Story et al.

(10) Patent No.: US 6,460,536 B2
(45) Date of Patent: Oct. 8, 2002

(54) HYDRAULICALLY POWERED RAIL PRE-HEATER

(75) Inventors: Ralph S. Story, Mayfield, KY (US); Johnny D. Burnett, Paducah, KY (US)

(73) Assignee: Matweld, Inc., Paducah, KY (US)

( * ) Notice: Subject to any disclaimer, the term of this patent is extended or adjusted under 35 U.S.C. 154(b) by 73 days.

(21) Appl. No.: 09/796,417

(22) Filed: Feb. 28, 2001

(65) Prior Publication Data

US 2002/0117164 A1 Aug. 29, 2002

(51) Int. Cl.[7] ..... F23C 5/00

(52) U.S. Cl. ..... 126/271.2 B; 126/271.2 R

(58) Field of Search ..... 126/271.2 R, 271.2 A, 126/271.2 B, 271.2 C; 47/1.44; 246/428

(56) References Cited

U.S. PATENT DOCUMENTS

| | | | | | |
|---|---|---|---|---|---|
| 161,718 | A | * | 4/1875 | Waterberry | 126/271.2 C |
| 2,413,388 | A | * | 12/1946 | Smith | 126/271.2 B |
| 2,530,894 | A | * | 11/1950 | McLemore | 126/271.2 C |
| 2,610,622 | A | * | 9/1952 | Coggin | 126/271.2 C |
| 2,839,047 | A | * | 6/1958 | Davisson et al. | 126/271.2 C |
| 3,291,118 | A | * | 12/1966 | Wilson | 126/271.2 C |
| 3,451,470 | A | * | 6/1969 | Herrick | 104/2 |
| 3,525,326 | A | * | 8/1970 | Deal | 126/271.2 A |
| 3,534,725 | A | * | 10/1970 | Davis | 126/271.2 A |
| 3,698,380 | A | * | 10/1972 | Cook | 126/271.2 A |
| 3,724,403 | A | * | 4/1973 | Frantzen | 110/189 |
| 3,805,766 | A | * | 4/1974 | Hammon | 126/271.2 C |
| 3,946,722 | A | * | 3/1976 | Banahan | 126/343.5 A |
| 4,860,727 | A | * | 8/1989 | Eads et al. | 110/240 |
| 5,953,856 | A | * | 9/1999 | Baiamonte et al. | 126/271.2 R |

FOREIGN PATENT DOCUMENTS

| | | | | |
|---|---|---|---|---|
| AT | 16604 | * | 11/1928 | 126/271.2 |
| FR | 2 565 536 | * | 12/1985 | 431/354 |
| GB | 1 188 455 | * | 4/1970 | 431/354 |

* cited by examiner

*Primary Examiner*—Carl D Price
(74) *Attorney, Agent, or Firm*—Lloyd L. Zickert

(57) ABSTRACT

A hydraulically powered rail pre-heater for heating rail ends before they are welded together, which includes a blower driven by a hydraulic motor for producing a substantially constant flow of air, a source for propane gas or other combustible media to be regulated and mixed and then delivered to a torch for the application of a flame to the rail ends.

7 Claims, 4 Drawing Sheets

HYDRAULICALLY POWERED RAIL PRE-HEATER

DESCRIPTION

This invention relates in general to a pre-heater for heating up rail ends before they are welded together, and more particularly to a pre-heater having a hydraulically powered blower and a source for propane gas or other combustible media to be regulated and mixed to produce a fuel mixture for a torch.

BACKGROUND OF THE INVENTION

It is well known to weld together the ends of rail used in railroad track particularly to provide a continuous track. It is also well known to weld rail ends together using an aluminothermic process or any comparable process. Before making a weld by such a process, it is well known to preheat the rail ends to enhance the efficiency of the welding process.

It is also well known to preheat rail ends by use of a type of bottled fuel supply system to produce the heat necessary for preheating process. Work crews must handle gas bottles that are very cumbersome and that carry a monthly demurrage charge. Further, these gas bottles or tanks must be stored on trucks where storage space is at a premium, are cumbersome to handle, and the work crews sometimes have difficulty in finding and locating businesses for exchange of empty bottles or tanks.

SUMMARY OF THE INVENTION

The pre-heater of the present invention overcomes the problems encountered with prior known pre-heaters wherein the pre-heater of the invention not only employs a hydraulically powered blower but also utilizes propane gas or other fuel as the combustible media.

Railroad maintenance crews have a source of hydraulic power so that the hydraulic powered blower can easily be driven. Secondly, use of propane gas enables the crew to purchase propane gas or fill propane tanks at any number of local stores frequented by consumers that provide such propane service. These local stores include discount stores, home stores, farm stores, gas stations, small grocery stores and others. These propane tanks are portable and can be easily carried to and from a truck by a single person, as they are the types used in outdoor barbecue grills. Further, such propane tanks do not take up a lot of space, are economical, and could allow elimination of acetylene gas and oxygen bottles on trucks. The pre-heater of the invention is portable and easily handled by crew members.

It is therefore an object of the present invention to provide a new and improved pre-heater for rail ends that will facilitate the welding of rail ends, wherein the pre-heater includes a hydraulically driven blower and a source for propane gas or other combustible media to be regulated and mixed.

Another object of the present invention is in the provision of a portable rail pre-heater having a minimum number of parts and which is fueled by propane gas or other combustible media from a tank or bottle, and the tank or bottle may be easily obtained or filled at any local store outlet servicing such tanks or bottles.

A further object of the present invention is to provide a hydraulically powered pre-heater for heating rail ends before they are welded together and which includes a hydraulically driven blower to produce a substantially constant air flow and a source for propane gas or other combustible media from a simple tank or bottle that can be regulated and mixed and then delivered to a torch for producing a flame to heat up rail ends.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
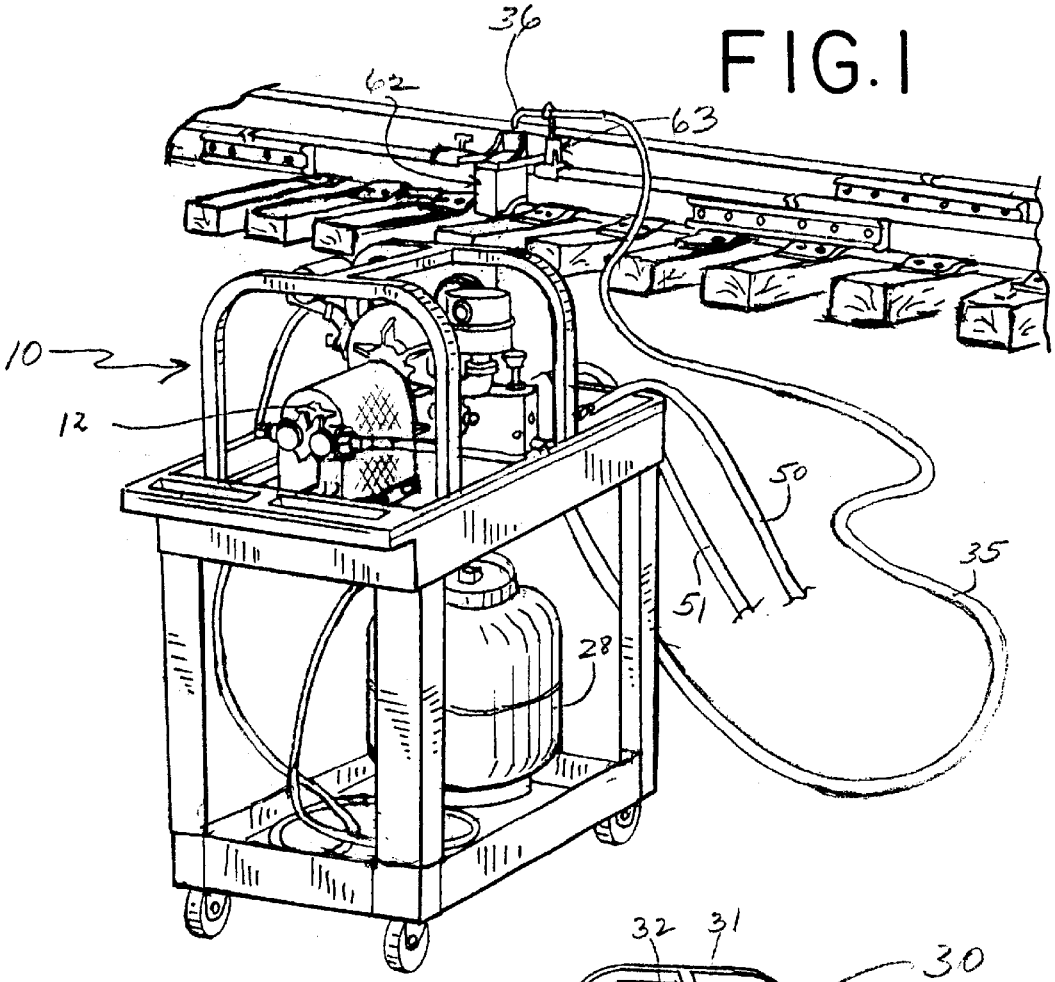
FIG. 1 is a perspective view of the pre-heater of the present invention supported on a mobile cart and showing the connection of the air fuel mixture line to a torch at a track location to preheat rail ends.
Figure 2:
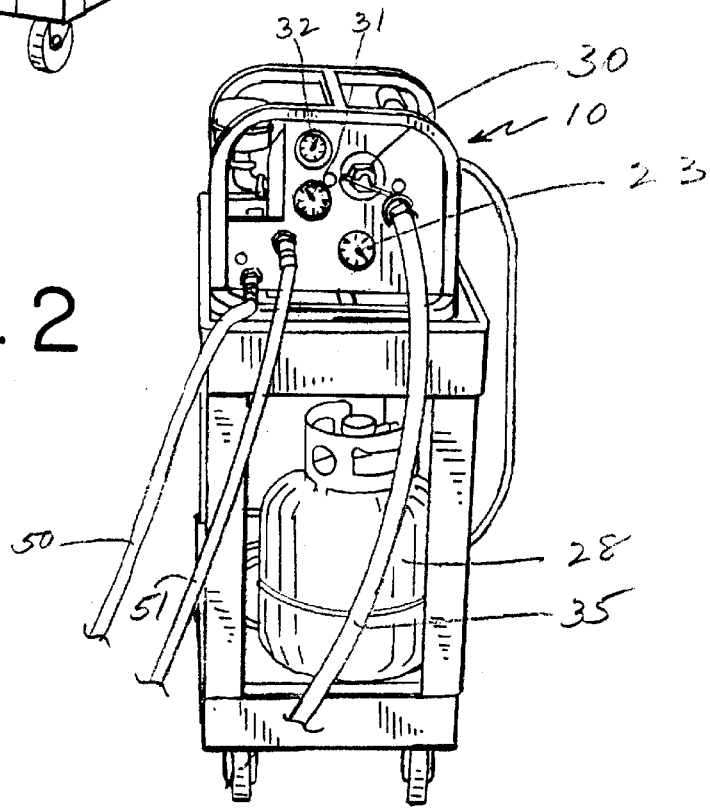
FIG. 2 is a front elevational view of the pre-heater of the invention illustrating the fittings for providing a source of hydraulic power to the pre-heater and a fitting for connecting the line carrying the propane gas/air mixture to the torch.

This invention relates to a rail pre-heater used for preheating rail ends before they are welded together during the construction of endless track. The work sites for welding rail ends in the repair of railroad track are located wherever along the track such welding operations are needed, and accordingly, equipment for performing the welding operations is preferably somewhat portable. It is essentially necessary to preheat rail ends before welding and particularly those that are welded together by an aluminothermic or any comparable process. The usual method of preheating involves flame heating of the ends, and the present invention is to a generally portable pre-heater that may be easily used and operated from readily available power sources.

This pre-heater includes a blower driven by a hydraulic motor mounted on a frame, together with means for regulating and mixing air and a combustible media or flammable fuel. The pre-heater may be positioned on an equipment truck or on the ground near the work site, although it is illustrated in the drawings as being supported on a mobile shop cart. Thus, the pre-heater includes a hydraulically driven blower for producing air and a source of fuel under pressure to be regulated and mixed with the air to produce a fuel mixture for a torch.

The blower is of a type that produces a substantially constant volume of air that is mixed with the combustible media at a predetermined ratio and delivered to a line supplying the fuel/air mixture to a torch mountable at the welding location of the work site. The combustible media is under pressure, and a regulator is provided to control the combustible media flow to a mixer that mixes the air produced by the blower with the media prior to delivering the mixture to the fuel line leading to the torch. Preferably, propane gas is provided as the source of combustible media. The propane gas is provided from a portable tank or bottle of the type that may be easily serviced in any number of stores servicing small propane tanks, such as one used to provide fuel to barbecue grills. The tank will be placed in close proximity to the pre-heater so that it may easily be connected to provide the source of combustible media. It is shown in the drawings for simplicity purposes to be also carried by the mobile shop cart. It will be understood that the shop cart would not normally be provided at the work site where pre-heating is desired. Hydraulic power from a suitable source is provided to drive the hydraulic motor connected to the blower. A suitable source of hydraulic power is normally available to a crew working on maintenance and repair of a track bed.

Figure 8:
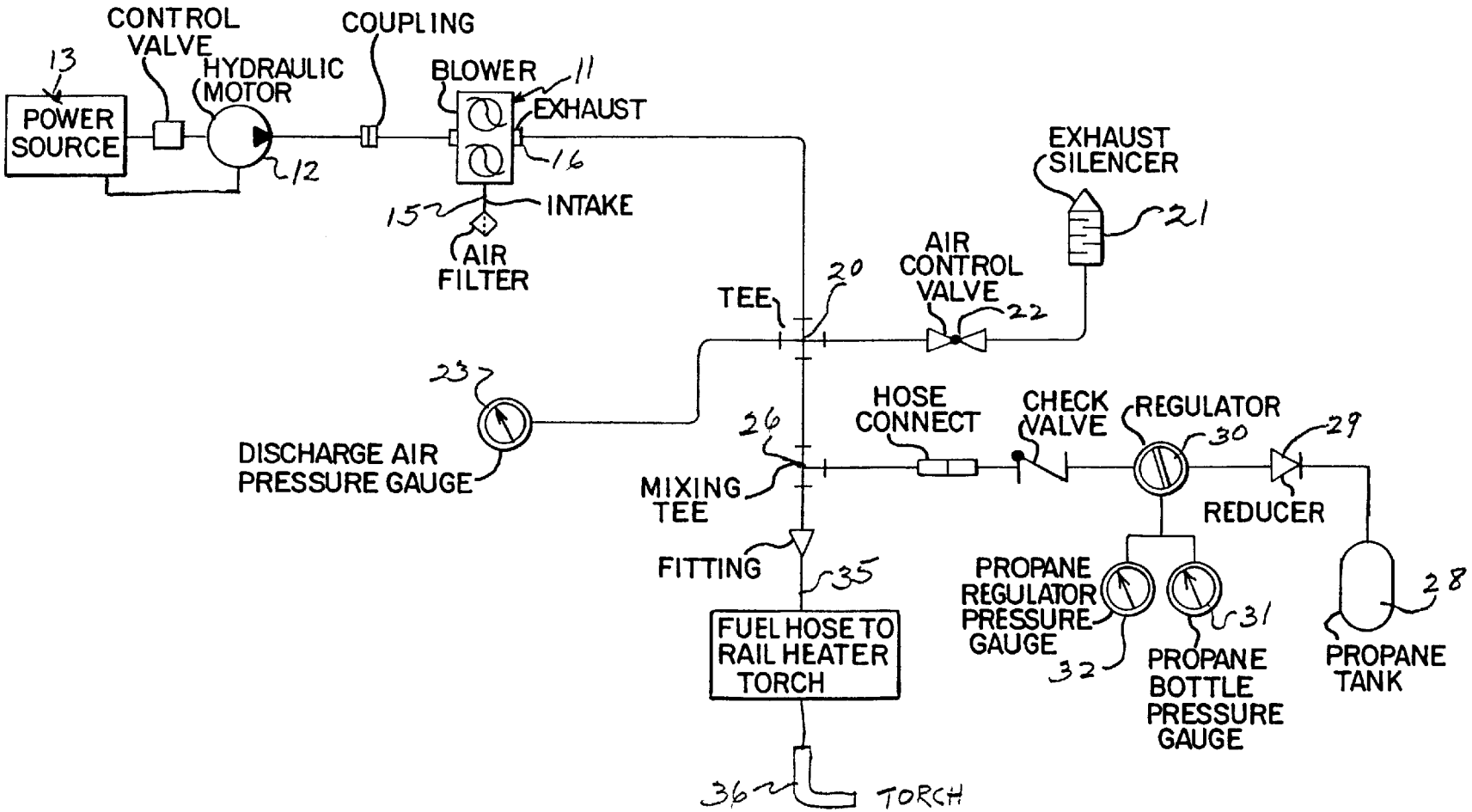
FIG. 8 is a schematic diagram of the pre-heater of the invention and showing the sources of hydraulic power, propane gas, or other combustible media.

Referring now to the drawings, and particularly to FIG. 8, a schematic diagram of the pre-heater illustrates the components for producing the fuel for a torch. The pre-heater is generally designated by the numeral 10 and includes a blower 11 capable of producing a substantially constant volume of air flow at a predetermined pressure. Any conventional blower may be used. The blower is driven by a conventional rotary hydraulic motor 12 having an output shaft connected to the input shaft of the blower by a suitable coupling. The hydraulic motor is powered by high pressure fluid from a hydraulic power source 13. The blower includes an air intake 15 and an air discharge or exhaust 16. The discharge air from the blower is delivered to a tee 20 that is connected to an exhaust silencer 21 through an air control valve 22. The tee is also connected to a discharge air pressure gauge 23 and to a mixing tee 26.

Propane gas is delivered to the mixing tee from a propane gas tank 28 through a reducer 29 and a regulator 30. A propane tank pressure gauge 31 monitors the gas pressure in the propane tank 28, while a propane gas regulator pressure gauge 32 monitors the status of the regulator 30 as to the gas pressure going to the mixing tee.

The mixing tee is also connected to a fuel delivery line 35 having a torch 36 on the end for producing a flame to heat the adjacent rail ends.

Figure 4:
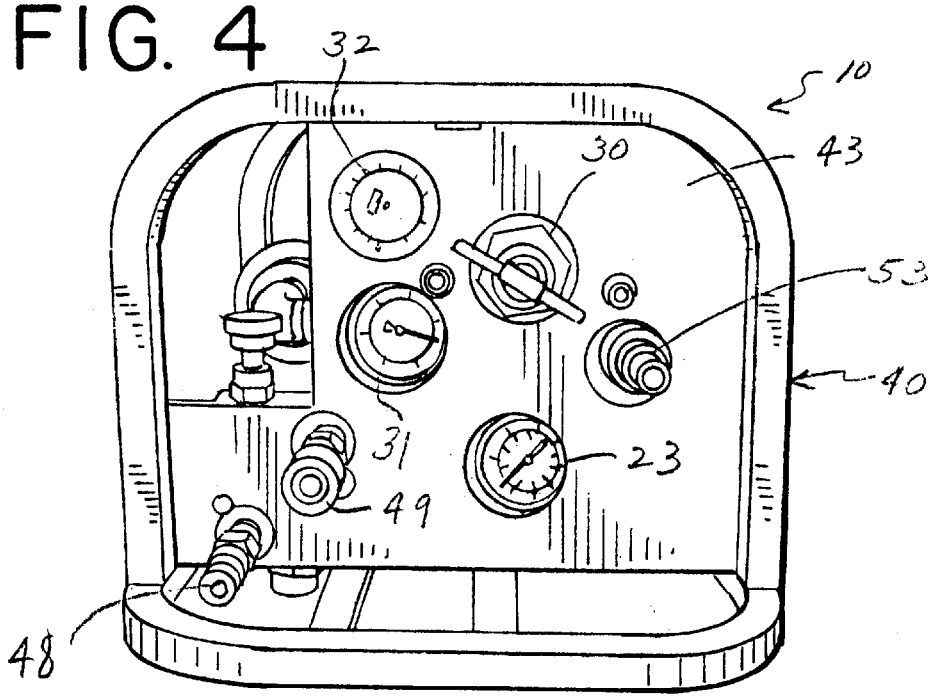
FIG. 4 is an enlarged front elevational view of the pre-heater with the lines removed for purposes of clarity.
Figure 5:
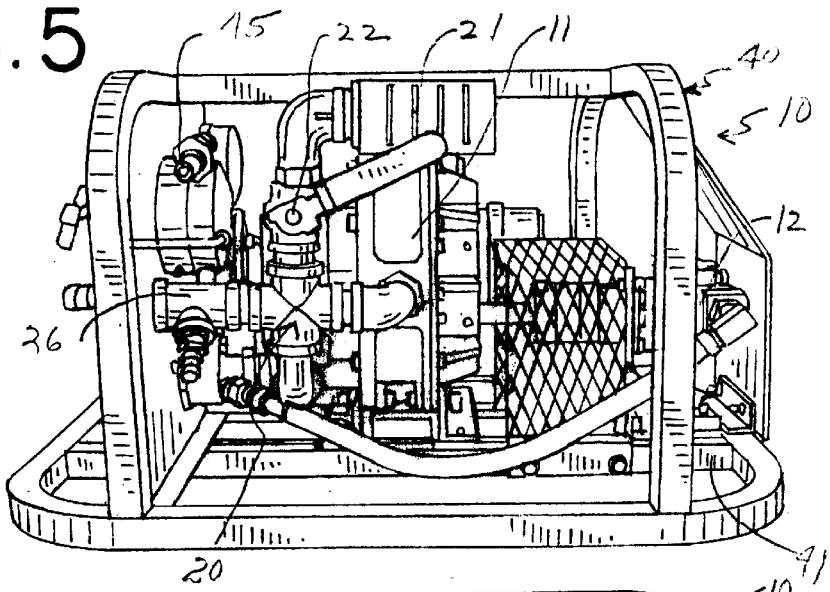
FIG. 5 is a side elevational view of the pre-heater of FIG. 4 with the lines removed and showing the connections from the blower to the mixing chamber.
Figure 6:
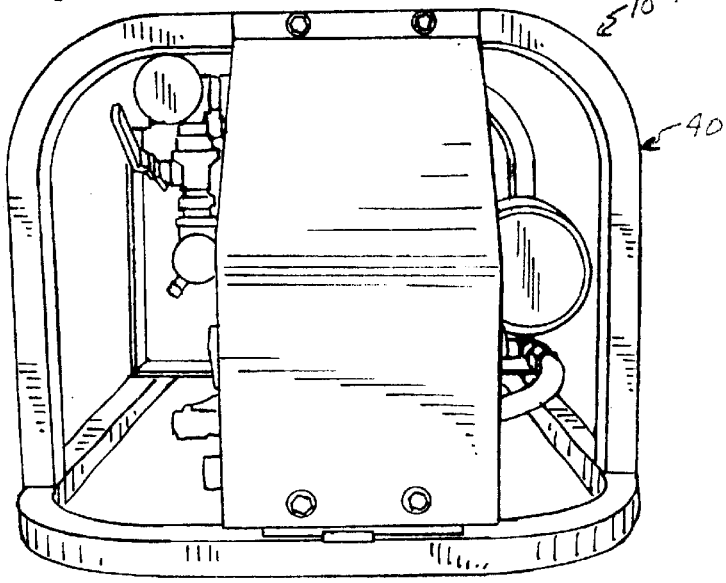
FIG. 6 is a rear elevational view of the pre-heater of FIG. 4.
Figure 7:
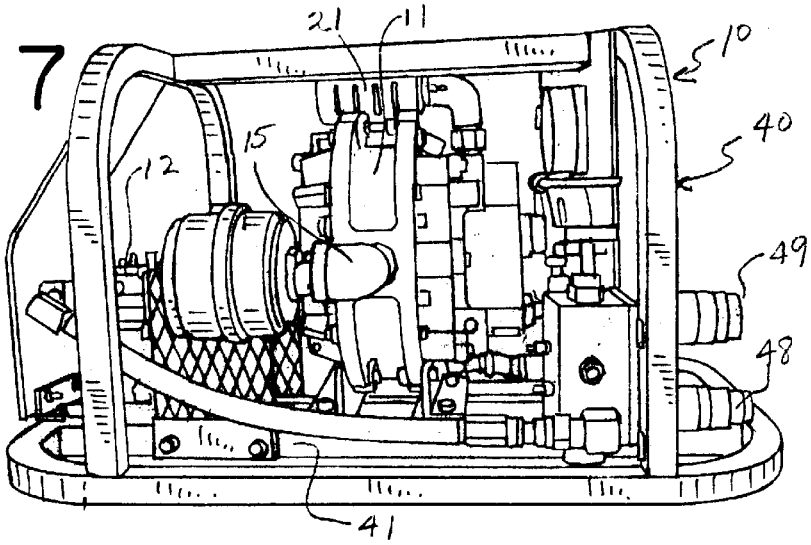
FIG. 7 is a side elevational view of the pre-heater of FIG. 4 showing the opposite side from FIG. 5.

As seen in FIGS. 4, 5, 6 and 7, the pre-heater components are mounted on a tubular frame 40 made of a plurality of tubular sections including base tubular sections 41. The blower 11 is mounted on the tubular sections 41 as is the hydraulic motor 12 which has an output shaft connected to the drive shaft of the blower. As seen in FIG. 5, the tee 20 includes four fittings, one of which is connected to the air discharge 16 of the blower; another is connected to a line going to the air control valve 22 for controlling the air output of the blower and the silencer 21, while another is connected to the mixing tee 26; and the last is connected to the discharge air pressure gauge 23 as mounted on a vertically extending control plate 43 suitably secured to the frame, as shown in FIG. 4.

Figure 3:
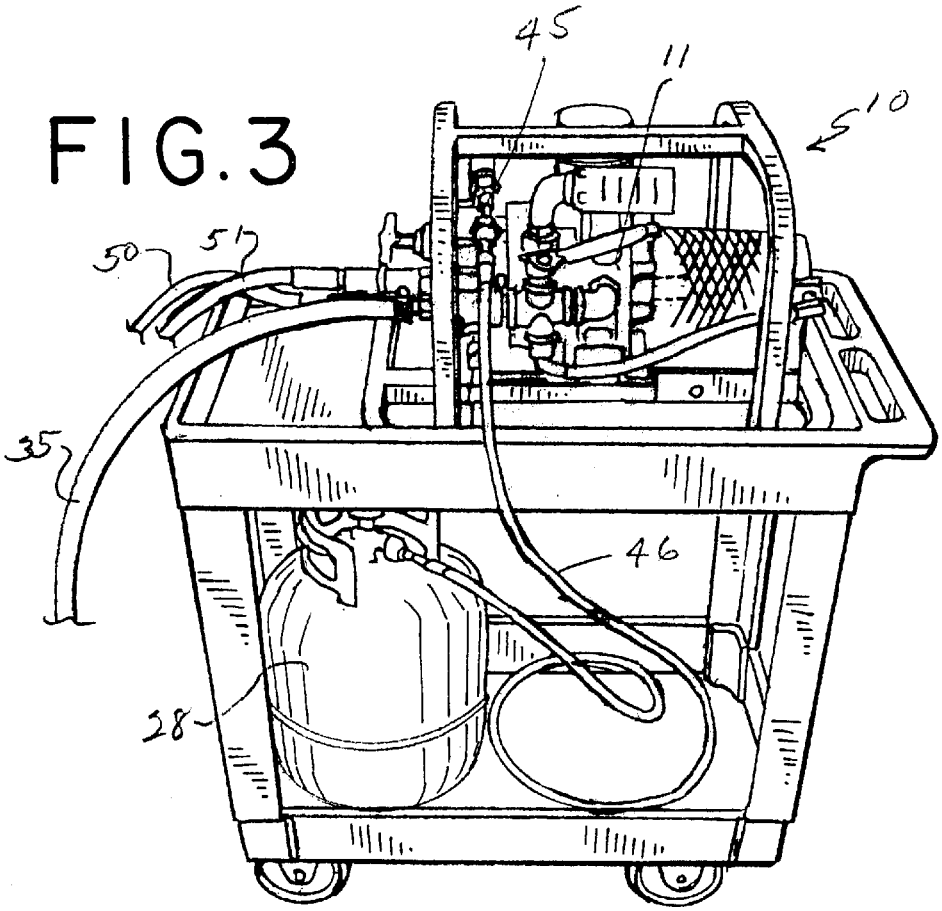
FIG. 3 is a side elevational view of the pre-heater of FIGS. 1 and 2.

The mixing tee 26 includes a fitting 45 connected to a line 46 leading to the propane tank 28, as seen in FIG. 3. It will be understood that the fitting 45 is connected to the regulator 30, which is serially connected through a check valve 47 to the mixing tee.

It will also be seen in FIG. 4 that the propane tank pressure gauge 31 is mounted on the control panel 43 along with the regulator 30 and the propane regulator pressure gauge 31.

Fittings 48 and 49 are mounted on the control panel 43 for connection to hydraulic lines 50 and 51, respectively, that are provided by the hydraulic power source. One of the lines brings pressurized fluid to the hydraulic motor, while the other returns the spent fluid to the reservoir or tank of the hydraulic power source.

A fitting 53 is provided on the control panel 43 for connection to the fuel delivery line 35 for the torch 36. It will be appreciated that the fittings 48 and 49 are also connected to hydraulic lines leading to the hydraulic motor 12, while the fitting 53 is connected to the output of the mixing tee 26. Preferably, the fittings on the control panel and the counterpart fittings on the lines are of the quick connect type to facilitate connection of the lines to the pre-heater.

Components of the pre-heating system are transported to a work site by any suitable vehicle, such as a truck. The components may be left on the truck if the truck can be parked close enough to the work site, or removed from the truck to a location near the work site. The tank of propane gas is connected to the pre-heater, along with the hydraulic lines and the fuel delivery line going to the torch. The hydraulic lines are connected to a suitable source of hydraulic power.

As seen particularly in FIG. 1, a welding fixture 62 is suitably secured to adjacent rail ends for welding the rail ends together with a suitable welding process. A mounting fixture 63 for the torch 36 is also secured to one of the rails for receiving the torch so that the discharge end of the torch is directed into the fixture. It is thereafter conventional to start the blower, turn on the propane gas for mixing of air from the blower with the gas, adjust the gas and air flow, and then igniting the fuel at the torch to provide a flame for heating the rail ends. While a crew would normally carry one or more spare propane tanks so that an empty tank can immediately be replaced with a full one, empty tanks can easily be filled at any local store servicing small propane tanks. It is believed that use of small propane tanks and a blower will produce a better controlled burn rate than can be produced by an acetylene/oxygen system.

It will be understood that modifications and variations may be effected without departing from the scope of the novel concepts of the present invention, but it is understood that this application is to be limited only by the scope of the appended claims.

The invention is hereby claimed as follows:

1. A portable rail preheater for preheating the ends of adjacently positioned rails at a welding site prior to welding the rail ends together which comprises:

a frame having a base section and upstanding sections, said upstanding sections of said frame including means for facilitating the lifting and transporting of the preheater by a worker, a blower mounted on the base section for generating a substantially constant volume of air flow to an air output, a mixing tee mounted on the frame for producing an air/fuel mixture and having an air inlet, a fuel inlet, and an air/fuel mixture outlet, means connecting the air output of the blower to the air inlet of the mixing tee, means for connecting the fuel inlet to a source of fuel under pressure, means for connecting the air/fuel outlet of the mixing tee to a torch disposed at the welding site for producing and directing a flame to the ends of the rails for heating the rails, a hydraulic motor mounted on the base section and drivingly connected to the blower, and means on the frame for connecting the hydraulic motor to a hydraulic power source, whereby the preheater is sized and packaged to permit a worker to easily carry and move the preheater from a storage site to a work site or from one work site to another work site.

2. The portable rail preheater of claim 1, which further includes means mounted on the frame and connected between the mixing tee fuel inlet and the source of fuel for controlling the flow of fuel to the mixing tee.

3. The portable rail preheater of claim 2, wherein the means for controlling the rate of fuel flow includes a pressure regulator.

4. The portable rail preheater of claim 1, wherein the source of fuel includes a tank of propane gas under pressure and refillable at any store servicing propane tanks.

5. The portable rail preheater of claim 1, which further includes means carried on the frame for controlling the air output of the blower.

6. The portable rail preheater of claim 4, wherein said means for controlling the air output of the blower includes an air control valve connected to the air output.

7. The portable rail preheater of claim 1, which further includes a control panel mounted on the frame having gauges for indicating the fuel pressure of the fuel source, the air pressure at the air inlet to the mixing tee, and the fuel pressure at the fuel inlet to the mixing tee.

* * * * *